US007210460B2

(12) United States Patent
Douyama et al.

(10) Patent No.: US 7,210,460 B2
(45) Date of Patent: May 1, 2007

(54) BYPASS PRESSURE REGULATOR

(75) Inventors: Yoshiaki Douyama, Shiroishi (JP); Kerry E. Grifka, Ubly, MI (US); Kevin L. Israelson, Cass City, MI (US); Ronald H. Roche, Cass City, MI (US); Edward J. Talaski, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 31 days.

(21) Appl. No.: 11/114,843

(22) Filed: Apr. 26, 2005

(65) Prior Publication Data

US 2006/0236983 A1 Oct. 26, 2006

(51) Int. Cl.
*F02M 69/54* (2006.01)
*F02M 69/52* (2006.01)

(52) U.S. Cl. ..... 123/457; 137/115.6

(58) Field of Classification Search ..... 123/457, 123/459, 509, 514; 137/115.16, 115.01, 137/115.13
See application file for complete search history.

(56) References Cited

U.S. PATENT DOCUMENTS 2,516,508 A * 7/1950 Donner ..... 417/304
4,181,144 A * 1/1980 Landen ..... 137/484.4
4,616,672 A * 10/1986 Schmidt ..... 137/107
5,220,941 A 6/1993 Tuckey
5,265,644 A 11/1993 Tuckey
5,313,978 A * 5/1994 Takaki et al. ..... 137/43
5,577,478 A 11/1996 Tuckey
5,579,739 A 12/1996 Tuckey et al.
5,619,972 A 4/1997 Kuenzli et al.
5,623,910 A * 4/1997 Riggle ..... 123/510
5,727,529 A 3/1998 Tuckey
5,842,455 A 12/1998 Tuckey et al.
5,975,061 A 11/1999 Briggs et al.
2004/0112429 A1* 6/2004 Mack ..... 137/115.13

* cited by examiner

*Primary Examiner*—Mahmoud Gimie
(74) *Attorney, Agent, or Firm*—Reising, Ethington, Barnes, Kisselle, P.C.

(57) ABSTRACT

A low cost bypass pressure regulator preferably for a return-less fuel system supplying liquid fuel to a fuel injector of the combustion engine. The pressure regulator preferably has a valve head disposed at least in part in a valve chamber defined by a circumferentially continuous inner surface carried by a valve body and which transitions radially outward with respect to a center axis and in a downstream direction. The valve head preferably tapers radially inward from a downstream peripheral outer edge of the head. In a closed position, the valve head engages a seat carried by the body with the peripheral outer edge downstream of the seat and radially spaced from and fitted closely to the valve chamber continuous inner surface thus defining a close fit region therebetween. As the valve head opens, the flow cross-section enlarges which reduces or eliminates oscillation of the valve head.

31 Claims, 6 Drawing Sheets

BYPASS PRESSURE REGULATOR

FIELD OF THE INVENTION

This invention relates to pressure regulators and more particularly to a bypass pressure regulator for controlling the pressure and flow rate of liquid.

BACKGROUND OF THE INVENTION

In many liquid supply systems, and particularly fuel injection systems for combustion engines, it is desirable to supply liquid fuel to the fuel injectors from a fuel pump which continuously delivers a quantity of liquid fuel sufficient to supply the maximum fuel demand of the engine. Consequently, when the engine is operating under conditions which require less fuel, there is an excess of fuel being delivered from the fuel pump. This is especially true when the engine is idling and has an extremely low fuel demand while the fuel pump is still delivering a large quantity.

In such systems, a bypass pressure regulator is utilized to divert or bypass the excess fuel from the needed supply of fuel consumed by the engine. Preferably, the bypass liquid fuel is diverted back to the liquid supply source such as a fuel tank. In fuel system applications, the fuel pump is typically located inside the fuel tank. The bypass pressure regulator can be located in the tank and immediately downstream of the fuel pump thus diverting bypass fuel directly back into the fuel tank, or it can be located further downstream of the fuel pump and downstream of an injector fuel rail utilized as a manifold which communicates with the injectors. If the bypass pressure regulator is mounted downstream of the fuel injectors, a bypass fuel return line is needed to return the excess fuel back into the fuel tank. Whether the bypass pressure regulator is internal or external to the fuel tank, when utilizing a regulator, the fuel pump can operate continuously maintaining a high rate of fuel output to accommodate a rapidly changing demand for fuel at the engine.

Some previous bypass pressure regulators, such as that disclosed in U.S. Pat. No. 5,727,529, use a flexible diaphragm in a can which is spring biased to close a bypass passage. The diaphragm is responsive to an increase in fuel pressure acting thereon and when displaced, permits the fuel to flow through the bypass passage to be returned to the fuel tank. Although generally satisfactory in performance, and beneficial for the ability to accommodate thermally expanding or excess fuel, these bypass pressure regulators are expensive to manufacture because of the diaphragm and numerous parts. Furthermore, the diaphragm regulators are relatively large, and have a relatively slow response time causing undesirable fuel pressure pulsations which can affect the performance of the engine and can generate undesirable levels of noise in the fuel system or other liquid systems.

Other bypass pressure regulators, such as that disclosed in U.S. Pat. No. 5,975,061 and incorporated herein by reference, do not utilize a diaphragm. As best illustrated in FIG. 1, marked prior art, the bypass pressure regulator 20 typically has a valve body 22 defining a bypass passage 24 having an inlet 26 in communication with a fuel pump (not shown) and an outlet 28 in communication with a fuel tank (not shown). A valve assembly 30 is received in and controls the flow of fuel through the bypass passage 24. The valve assembly 30 is composed of many difficult to manufacture and assemble parts including an enlarged, disc-like valve head 32 attached concentrically to a valve shank 34 at one end and attached to a disc 36 at an opposite end. A spring 38 biases the regulator closed, and is compressed axially between the disc 36 and a radially inward projecting shoulder 40 of the valve body 22 through which the shank 34 projects in an upstream direction. A valve seat 42 carried by the body 22 faces generally downstream with respect to the bypass fuel flow (identified by arrow 44) and a resilient annular ring 46 attached to the enlarged head 32 releasably seals to the seat 42 when the regulator 20 is closed. So as not to obstruct bypass fuel flow 44 through the passage 24 and to expose the valve head 32 to the acting fuel pressure, numerous orifices 48 are formed in the disc 36 and shoulder 40 of the valve body 22 lending toward additional manufacturing costs and complexities.

Furthermore and unfortunately, known bypass pressure regulators like regulator 20 do not maintain a constant pressure drop through the valve under varying flow rates. In operation, the spring force and generally the area of the exposed head 32 determine the fuel pressure at which the valve will "crack" or begin to open. When the valve assembly 30 first starts to open, flow through the annulus between the valve head 32 and seat 42 develops at high velocities relative to the surrounding fuel. This high velocity produces a low pressure region 50 exerting a force on the valve assembly 30 which is additive to the spring force and thus tends to close the valve assembly 30. In known bypass pressure regulators this low pressure region can lead to unstable oscillations of the valve assembly 30, fuel pressure flow rate fluctuations and noise of the valve assembly. In extreme cases, the regulator can be damaged by the hammering effect of the components. Yet further, known bypass pressure regulators are not easily integrated into other components of a typical fuel system or pump module of a combustion engine, are relatively complex, and relatively expensive to manufacture.

SUMMARY OF THE INVENTION

A low cost bypass pressure regulator for liquid fuel flowing preferably in a returnless fuel system for a combustion engine communicates operatively with a conduit or storage vessel which flows fuel from a fuel pump of the fuel system to at least one fuel injector of the combustion engine. The pressure regulator preferably has a valve head disposed at least in-part in a valve chamber defined by a circumferentially continuous inner surface carried by a valve body and which transitions radially outward with respect to a center axis and in a downstream direction. The valve head preferably tapers radially inward with respect to the center axis in an upstream direction and from a peripheral outer edge of the head.

When the valve head is in a closed position, the valve head is seated sealably against a seat carried by the body and the peripheral outer edge which is spaced radially downstream of the seat is radially spaced from, but fitted closely to the continuous inner surface of the body thus defining a close fit region there-between. When the valve head is in an open position, the tapered valve head is spaced appreciably away from the seat and the peripheral outer edge is spaced appreciably radially inward from the body continuous inner surface thus defining a free flow region there-between. The movement of the valve head from closed to open is in a downstream direction, hence the free flow region is generally located downstream of the continuous inner surface portion which defines in-part the close fit region when the valve head is closed. Because the flow cross section spaced axially downstream of the seat generally enlarges as the valve head opens, a high velocity of liquid flow is moved away from the seat thus reducing the otherwise low pressure at the seat. By reducing or eliminating low pressure at the seat, oscillation of the valve head is reduced or eliminated. This also reduces fuel pressure and flow rate fluctuations and noise.

Preferably, the continuous inner surface of the body has a circular crest generally formed by the congruent meeting of a substantially cylindrical portion and a substantially conical or tapered portion of the continuous inner surface. When the valve head is in the closed position, its peripheral outer edge is substantially aligned axially to the circular crest to form the close fit region. When the valve head is in the open position, the peripheral outer edge shifts downstream axially well into the conical portion of the continuous inner surface thus forming the larger free flow region.

Preferably and advantageously, the flow cross section represented by the close fit region remains substantially constant and accounts for valve head-to-seat wear and manufacturing tolerances because the continuous inner surface in this region is cylindrical. Thus any shifting of the closed valve head over an extended period of time (i.e. wear) would simply shift the peripheral outer edge slightly upstream and the edge remains aligned axially to the cylindrical portion.

Preferably, the valve head is biased closed, not by a conventional diaphragm, but by a compression spring compressed axially between the valve head and a guide member of the valve body generally located downstream of the valve head. A valve stem preferably projects from the head through the guide member and preferably through the spring.

Objects, feature, and advantages of this invention include a bypass pressure regulator which produces a more uniform regulated output pressure and flow rate, is relatively inexpensive and versatile, quieter and less prone to producing noise, has a valve head which is less likely to oscillate, is robust, reliable, durable, maintenance free, of relatively simple design, easy to assemble, of economical manufacture and assembly and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
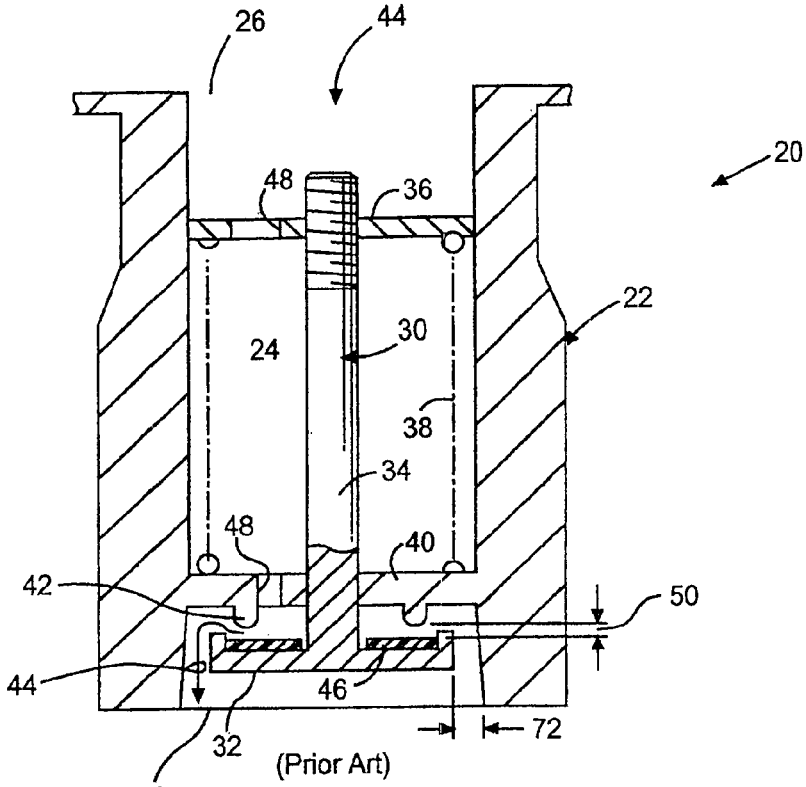
(Prior Art) FIG.1
FIG. 1 is a cross section of a prior art bypass pressure regulator.
Figure 2:
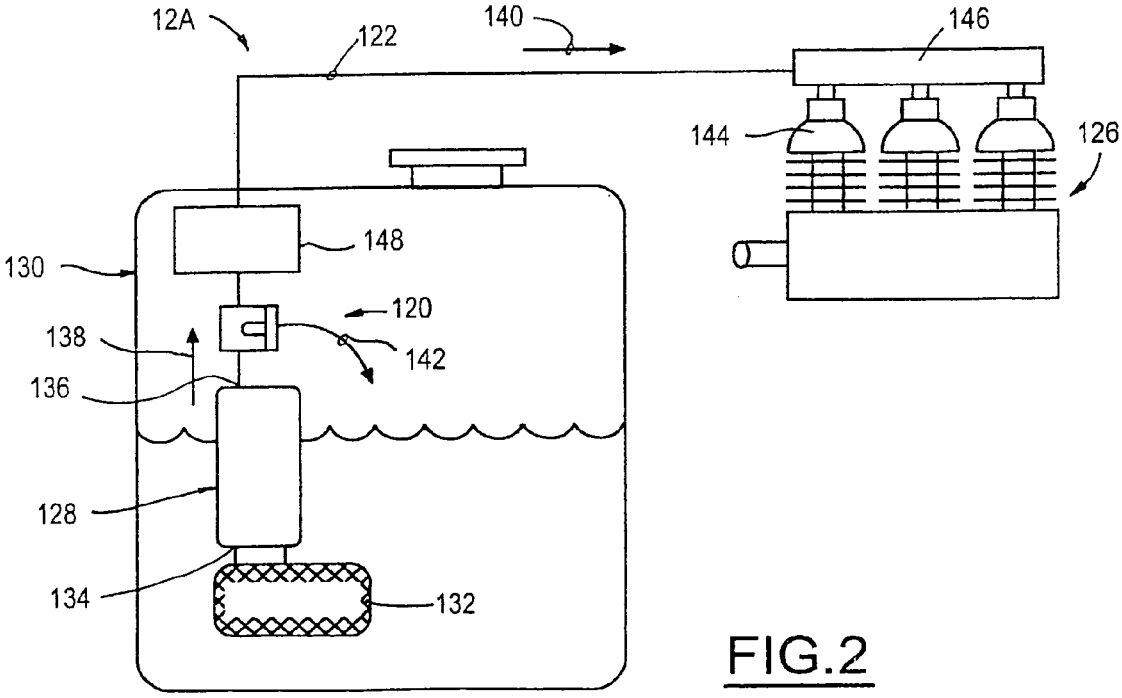
FIG. 2 is a schematic diagram of a fuel system utilizing a bypass pressure regulator embodying this invention.
Figure 3:
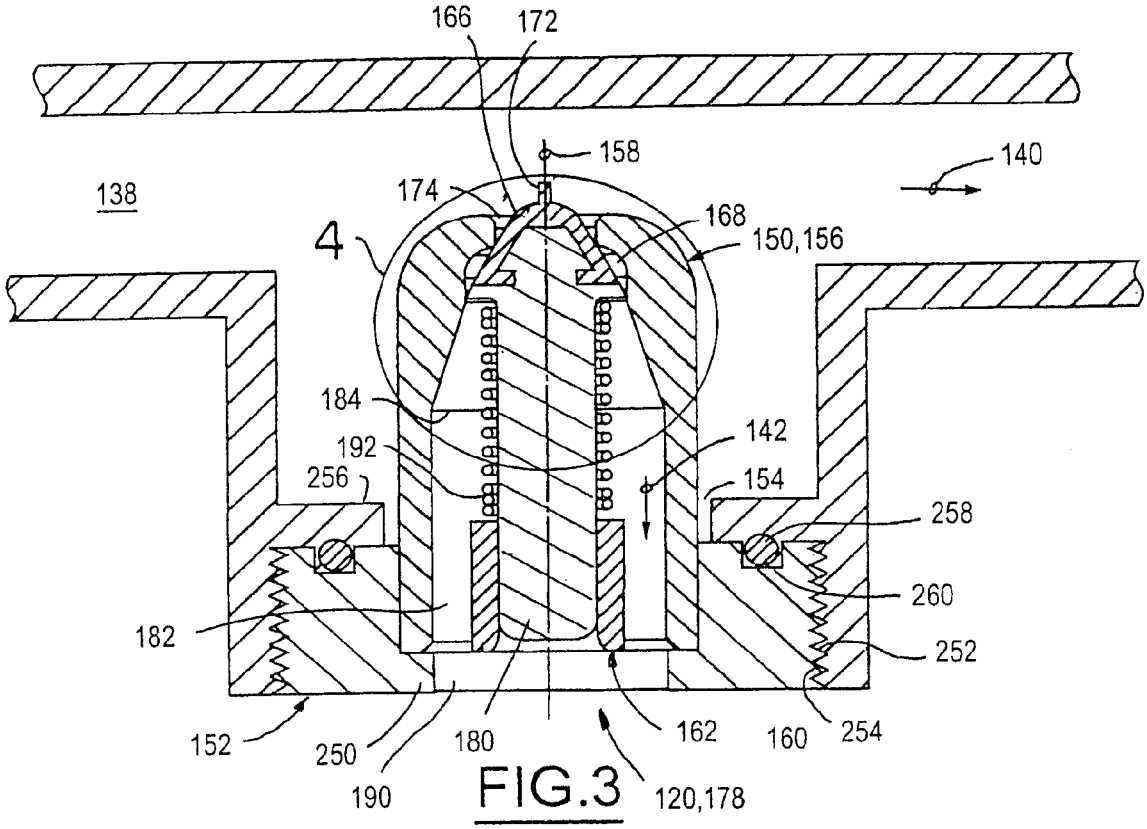
FIG. 3 is a cross section of the bypass pressure regulator shown in a closed position and integrated into a supply fuel conduit for pressure regulated fuel flow.

FIG. 3 illustrates a bypass pressure regulator 120 of the present invention utilized preferably in a flowing liquid conduit 122 which generally defines a supply passage or channel 138. FIG. 2 illustrates one preferred application of the regulator 120 in a preferably returnless fuel supply system 124 for a fuel injected combustion engine 126. In this particular application, the system 124 includes an electric fuel pump 128 preferably in a module located in a fuel tank 130. A pre-filter 132 is located generally at an inlet 134 of the fuel pump 128. The pump 128 supplies pressurized fuel at its outlet 136 which communicates directly with the channel 138 defined by the conduit 122 and to the bypass pressure regulator 120. The total output fuel flow from the pump 128 (indicated by arrow 139) is generally divided by the pressure regulator 120 as supply fuel to the engine (indicated by arrow 140) and bypass fuel (indicated by arrow 142). The total fuel output 139 flows into the bypass pressure regulator 120, or is generally exposed to an inlet of the regulator. The regulator 120 diverts the bypass fuel 142 generally back into the fuel tank 130 while controlling the fuel pressure of the supply fuel 140 which continues to flow in the channel 138 and to at least one fuel injector 144 preferably mounted to a fuel rail 146 of the combustion engine 126. Preferably, the supply fuel also flows through a filter 148 located in the conduit 122 downstream of the bypass pressure regulator 120.

The bypass pressure regulator 120 is integrated or generally housed in the conduit 122 of the returnless fuel supply system 124. The versatility of the regulator 120 is generally contributed substantially by a valve body 150 of the regulator 120 which is preferably comprised of three components; an annular retainer 152 engaged sealably to the conduit 122 at an opening 154, a dome structure 156 disposed about a center axis 158 and having a continuous base or end rim 160 fitted sealably to the retainer 152, and a guide member 162 preferably engaged axially between the end rim 160 of the dome structure 156 and the retainer 154. The dome structure 156 projects axially from the base rim 160, through the opening 154 of the conduit 122 and generally into the channel 138 where it converges generally to a distal end or an annular shaped apex 164 of the structure 150.

Figure 4:
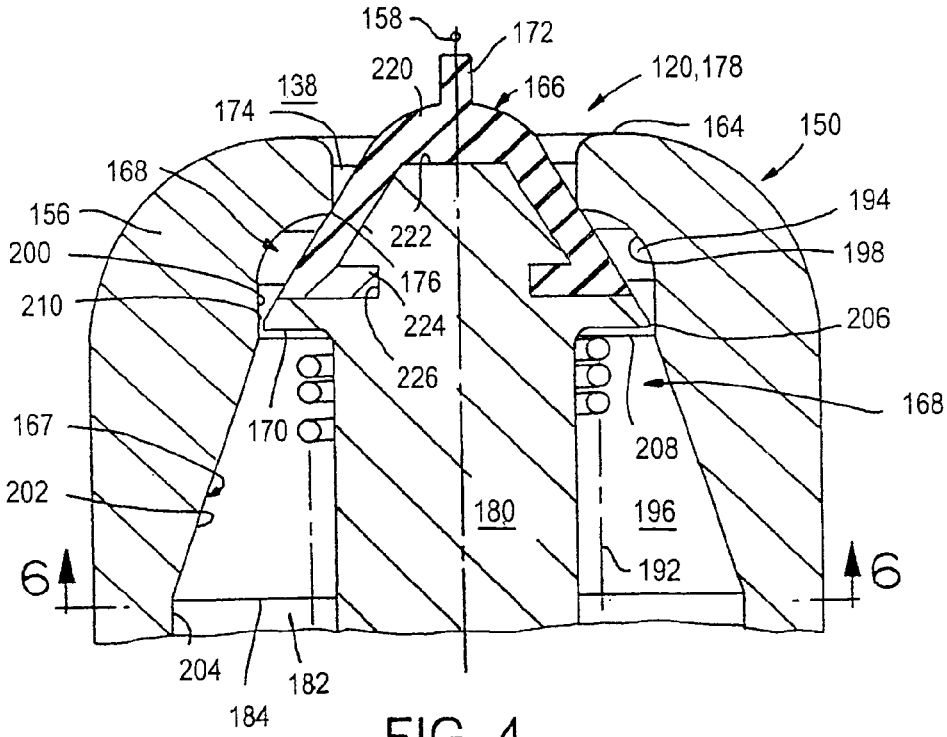
FIG. 4 is an enlarged partial cross section of the bypass pressure regulator taken from circle 4 of FIG. 3.
Figure 5:
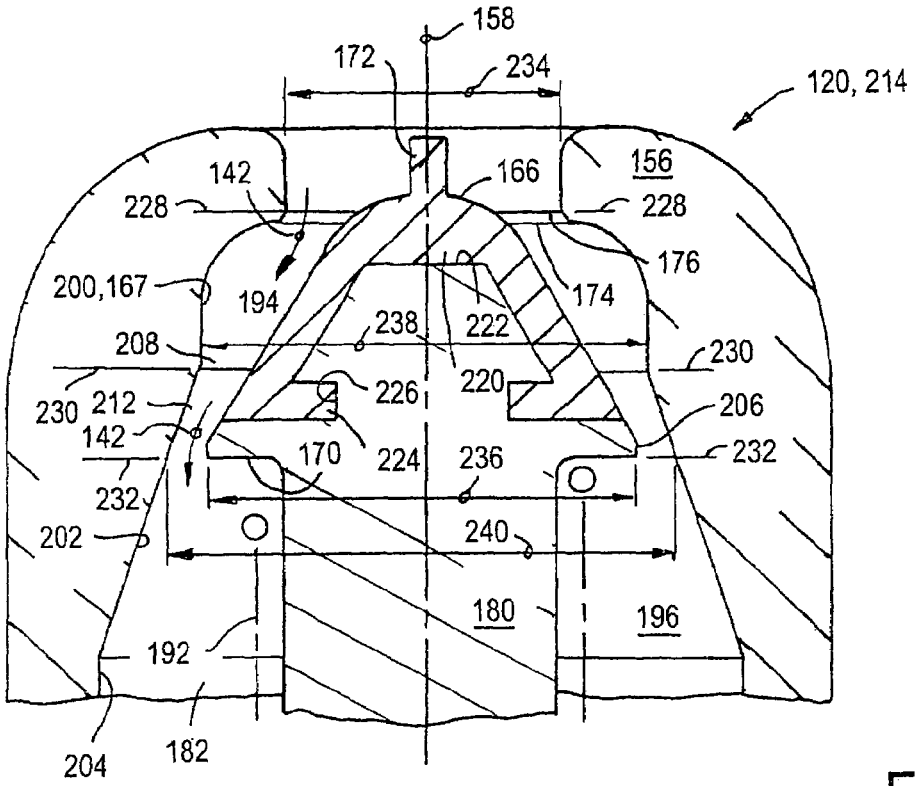
FIG. 5 is a partial cross section of the bypass pressure regulator similar to FIG. 4 but shown in an open position.

As best illustrated in FIGS. 3–5, the pressure regulator 120 preferably has an enlarged valve head 166 disposed substantially in a valve chamber 168 defined by a circumferentially continuous inner surface 167 that radially transitions outward in a downstream direction. The inner surface 167 is carried by the dome structure 150 and is orientated substantially concentric to the center axis 158. The head 66 preferably tapers radially inward in an upstream direction from a downstream facing annular shelf 170 and to a generally distal point 172. When the valve head 166 is in a closed position 178, the distal point 172 of the head 166 extends through an inlet port 174 of the chamber 168 generally at the apex 164. The inlet port 174 is defined generally by an annular valve seat 176 carried by the dome structure 156 which releasably seals to the tapered valve head 166.

A valve stem or shank 180, disposed concentrically to the center axis 158, projects axially in a downstream direction from the annular shelf 170 carried by the enlarged valve head 166 and generally through a bypass passage 182 in the dome structure 156 which communicates axially with the valve chamber 168 at an outlet port 184 of the chamber 168. The shank 180 extends through and is supported and guided by a substantially cylindrical collar portion 186 of the guide member 162 which is located in the bypass passage 182. A support structure 188 of the guide member 162 generally projects radially outward from a downstream end 246 of the collar portion 186, across a hole 190 of the retainer 152 which communicates with the bypass passage 182, and attaches rigidly to the dome structure 156 and/or retainer 152. The valve head 166 is biased closed against the valve seat 176 by a coiled compression spring 192 compressed between the annular shelf 170 of the enlarged valve head 166 and a distal annular end 193 of the collar portion 186 of the guide member 162.

The valve chamber 168 has an upstream bowl-shaped or rounded section 194 communicating directly with the inlet port 174, and a downstream conical frustum section 196 which generally expands radially outward from the rounded section 194 and communicates axially between the rounded section 194 and the outlet port 184. The bypass passage 182 is located concentrically to and directly downstream from the frustum section 196 and communicates with section 196 at the outlet port 184. The rounded section 194 is generally defined by an annular concave portion 198 and a cylindrical portion 200 of the inner surface 167. Portion 198 extends radially outward from the seat 176 as it extends axially in a downstream direction to the cylindrical portion 200. The frustum section 196 of the valve chamber 168 is generally defined by a radially expanding or frusto conical portion 202 of the inner surface 167 which extends axially, and radially expands in a downstream direction, from the cylindrical portion 200 and to a substantially cylindrical wall 204 of the dome structure 156 which defines the bypass passage 182 that extends axially to the end or base rim 160. For purposes of illustration, the union of the cylindrical wall 204 with the cylindrical portion 200 of the inner surface 167 is coaxial with the outlet port 184.

When the tapered valve head 166 is in the closed position 178, a peripheral outer edge 206, which generally defines the outer periphery of the valve head shelf 170, is aligned axially with the cylindrical portion 200 of the inner surface 167 preferably at or slightly upstream of a peripheral inner edge or circular crest 208 of the inner surface 167 formed by the congruent joining of the cylindrical portion 200 and the conical portion 202. The peripheral outer edge 206 of the valve head 166 and the cylindrical portion 200 of the dome structure 156 are slightly spaced apart radially from one-another just enough to prevent contact, thus providing interference-free seating of the valve head 166 with the seat 176. This small radial space or close fit region 210 between the peripheral outer edge 206 and the circular crest 208 generally enlarges to a free flow region 212 as the valve head 166 moves from the closed position 178 to an open position 214 (as best shown in FIG. 5).

When fuel pressure in the channel 138 of the conduit 122 generally exceeds the biasing force of the coiled compression spring 192, compressed axially between the upstream end 193 of the collar portion 186 of the guide member 162 and the annular shelf 170 of the tapered valve head 166, the biased closed valve head moves axially away from the seat 176 toward the open position 214, cracking the valve open and slightly compressing the spring 216 axially. Also when opening, the peripheral outer edge 206 of the tapered head 166 moves axially past the circular crest 208 and into the frustum section 196 of the valve chamber 168. Hence, upon initial cracking open of the pressure regulator 120, the close fit region 210 begins to enlarge because the radial distance between the peripheral outer edge 206 and the dome structure 156 increases due to the tapered conical portion 202 of the inner surface 167. This shift of the close fit region 210 to the free flow region 212 moves the high velocity of fuel flow away from the valve seat 176 which would otherwise create a low pressure region causing the valve head 166 to repeatedly briefly close and open or oscillate. Thus, enlargement of the close fit region 210 to the free flow region 212 greatly reduces and substantially prevents oscillation of the valve head 166 and reduces valve noise and seat wear.

Also for reducing valve noise and improving wear and sealing between the seat 176 and the head 166, the head has a resilient leading cover or glove 220 which covers a base segment 222 of the head 166. The cover 220 has a circular shoulder 224 which projects radially inward and press fits into a circular groove 226 of the base segment 222 which is spaced axially upstream of the annular shelf 170 and opens radially outward to receive the shoulder 224. The shank 180 and base segment 222 are preferably unitary and formed preferably of metal for durability, but could also be formed of injection molded plastic or other rigid materials. The cover 220 is preferably made of a fuel resistant synthetic rubber or polymer material.

Preferably and advantageously, the flow cross section represented by the close fit region 210 remains substantially constant and compensates or allows for valve head-to-seat wear and manufacturing tolerances because the continuous inner surface 167 in this region 210 is cylindrical. Thus any axial shifting of the valve head 166 while generally in the closed position 178 over an extended period of time (i.e. wear) would simply shift the peripheral outer edge 206 slightly upstream and the edge remains aligned axially to the cylindrical portion 204.

Figure 6:
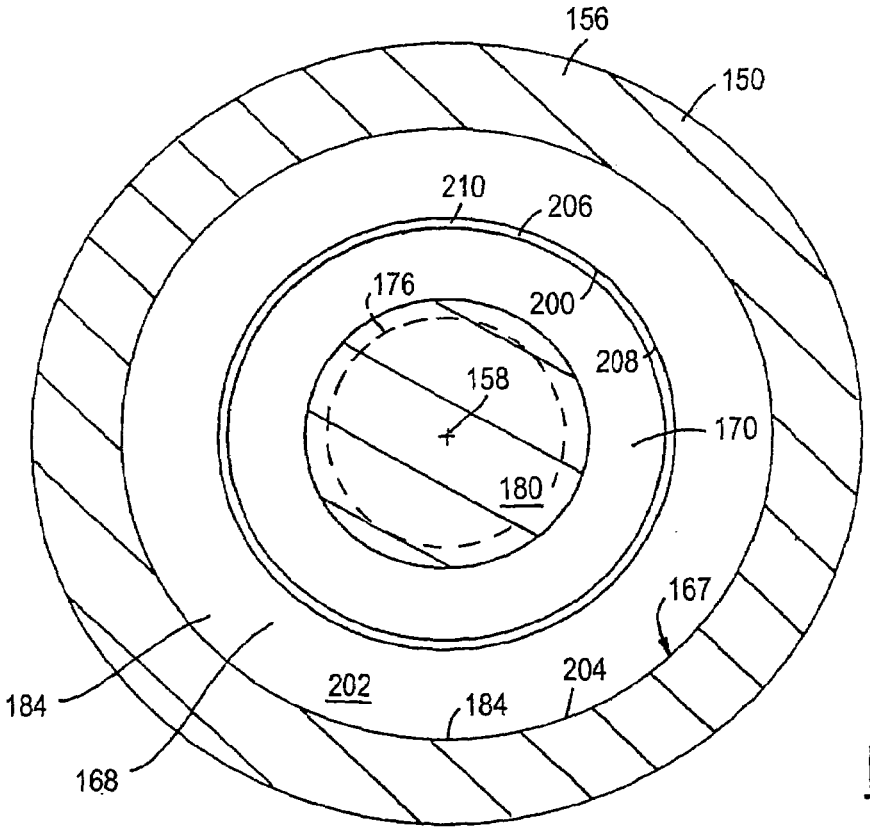
FIG. 6 is a cross section of the bypass pressure regulator taken along line 6—6 of FIG. 4.

As best illustrated in FIGS. 5 and 6, the bypass pressure regulator 120 can further be described with respect to three imaginary and substantially parallel planes 228, 230, 232, spaced apart axially and each being disposed perpendicular to the center axis 158. The valve seat 176 and generally the inlet port 174 are located in the first imaginary plane 228. The circular crest 208 is located in the second imaginary plane 230 and the radial clearance between the peripheral outer edge 206 and the conical portion 202 which represents the free flow region 212 is located generally in the third imaginary plane 232 when the pressure regulator is in the open position 214. Generally then, the rounded section 194 of the valve chamber 168 is defined axially between the first and second imaginary planes 228, 230, and the frustum or expanding section 196 of the valve chamber 168 extends from second imaginary plane 230 and communicates through the third imaginary plane 232 to the outlet port 184 located downstream of the third plane 232. When the valve head 166 is in the closed position 178 (shown in FIG. 4), the peripheral outer edge 206 and the annular shelf 170 generally lie in the second imaginary plane 230 and the tapered head 166 preferably projects axially through the first imaginary plane 230. When the valve head 166 is in the open position 214, the peripheral outer edge 206 and the annular shelf 170 generally lie in the third imaginary plane 232.

Because the valve head 166 is tapered, a diameter 234 of the seat 176 which lies in the first imaginary plane 228 is substantially smaller than a diameter 236 of the peripheral outer edge 206. To create the close fit region 210 when the valve head 166 is closed, the peripheral outer edge diameter 236 is slightly smaller than a diameter 238 of the cylindrical portion 200 and circular crest 208 of the inner surface 167.

Because the conical portion 202 of the inner surface 167 tapers radially outward in a downstream direction, the crest diameter 238 is appreciably smaller than a diameter 240 of the conical portion 202 which generally lies in the third imaginary plane 232. Preferably, and when the valve head 166 is in the fully open position 214, the annular flow area at the second imaginary plane 230 is generally equal to or larger than the annular flow area at the first imaginary plane 228, at the inlet port 174, and generally equal to or smaller than the annular flow area at the third imaginary plane 232 at the free flow region 212. This generally eliminates any pressure drop transients at the planes 230, 232, regardless of valve position, and thus generally places any fluid flow dynamics which may impact design considerations of the valve generally at the inlet port 174, simplifying sizing of the bypass pressure regulator 120 between varying applications.

The robust design of the valve head 166 and dome structure 156 has an axial tolerance which accounts for axial compression and/or wear of the resilient cover 220 with the seat 176. Slight wear or varying axial compression of the valve head cover 220 could cause the head 166 and peripheral outer edge 206 to shift slightly upstream essentially shifting the closed position 178 slightly upstream. The flow cross section of the close fit region 210, however, remains substantially constant because the peripheral outer edge 206 which is initially aligned axially to about the circular crest 208 can move slightly upstream due to wear, but remains aligned axially to the cylindrical portion 200 of the inner surface 167.

During assembly of the bypass pressure regulator 120, the cover 220 is preferably press fitted or overmolded into the circular groove 226 in the base segment 222 of the head 166. The shank 180 is then inserted axially through the coiled compression spring 216 and through the collar portion 186 of the guide member 162. The pre-assembled collar portion 186, the shank 180, the valve head 166 and the spring 192 are inserted in the dome structure 156 at the end rim 160 of the cylindrical wall 204. The collar portion 186 is easily centered to the center axis 158 by locating two chamfered distal ends 242 of two diametrically opposed legs 244 of the support structure 188 of the guide member 162, which project axially outward from a base end 246 of the collar portion, to the chamfered base end or rim 160 of the dome structure 156. When fitting the distal ends 242, the taper characteristic of the valve head 166 centers the head to the seat 176 and thus to the center axis 158. Also, the spring 192 which bears axially between the shelf 170 and the distal end 193 of the collar portion 186 axially compresses holding the head 166 on the seat 176. The base or rim end 160 of the dome structure 156 is then slid axially into a counter bore 248 of the retainer 152 until the base end 160 axially contacts a radially inward projecting annular shoulder 250 of the retainer 152. The shoulder 250 generally defines the bore or hole 190 for exiting bypass flow 142 from the bypass pressure regulator 120.

As thus assembled, the bypass pressure regulator 120 is a completed unit and is ready for integration into any variety of applications. Preferably, and as illustrated in FIG. 3, the retainer 152 carries male threads or a threaded exterior face 252 which thread into female threads 254 carried preferably by the conduit 122 at the opening 154 or any other type of vessel carrying pressurized liquid. Alternatively, the retainer 152 cam be press fitted into the conduit 122. As an additional sealing feature, the conduit 122 has a circular shelf 256 projecting radially inward which seals axially against a gasket 258 which is preferably an o-ring disposed in a circular groove 260 opened axially outward and carried by the retainer 152.

Figure 7:
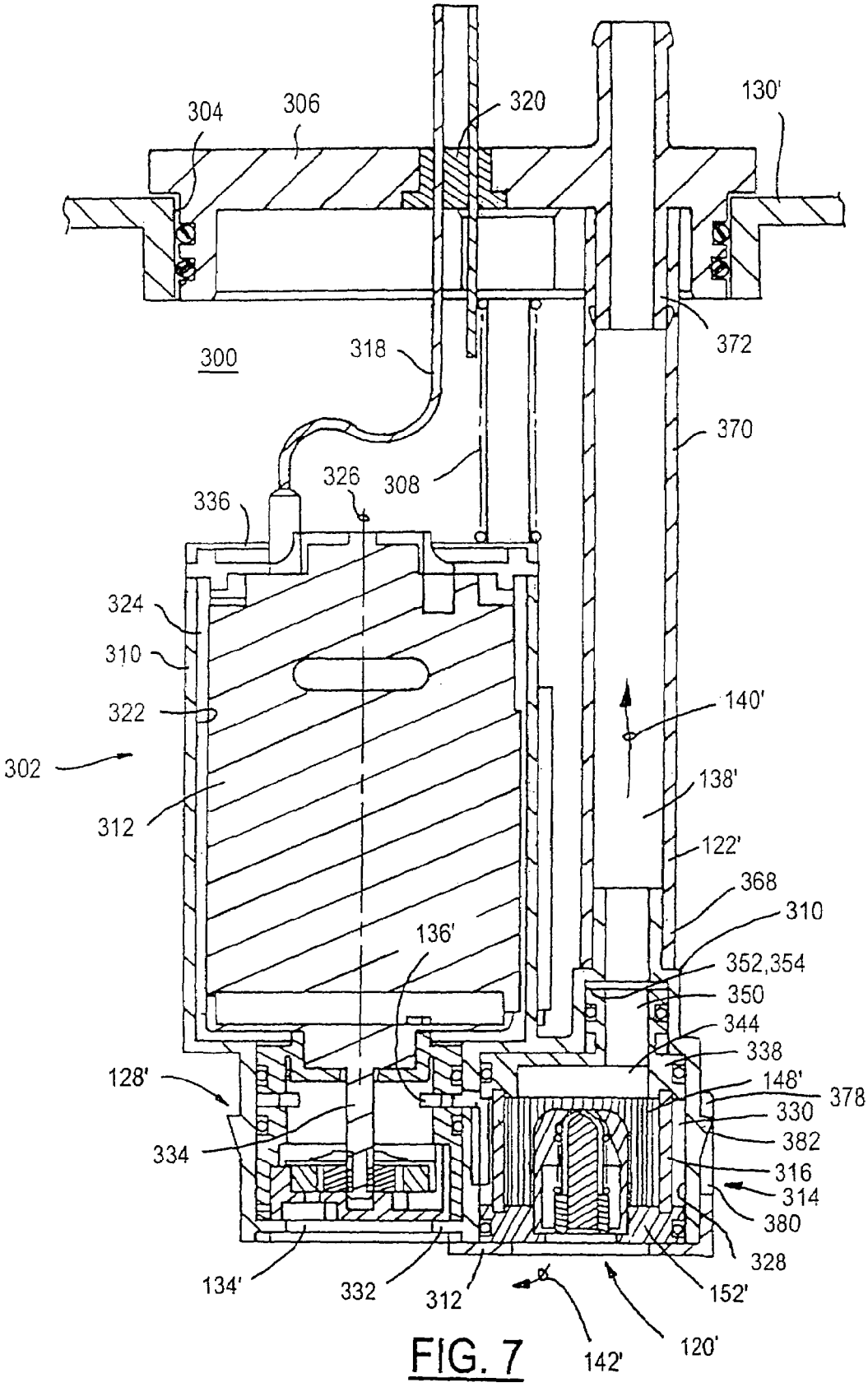
FIG. 7 is a second embodiment of the bypass pressure regulator integrated into a fuel filter cartridge utilized in a fuel pump module in a fuel tank.
Figure 8:
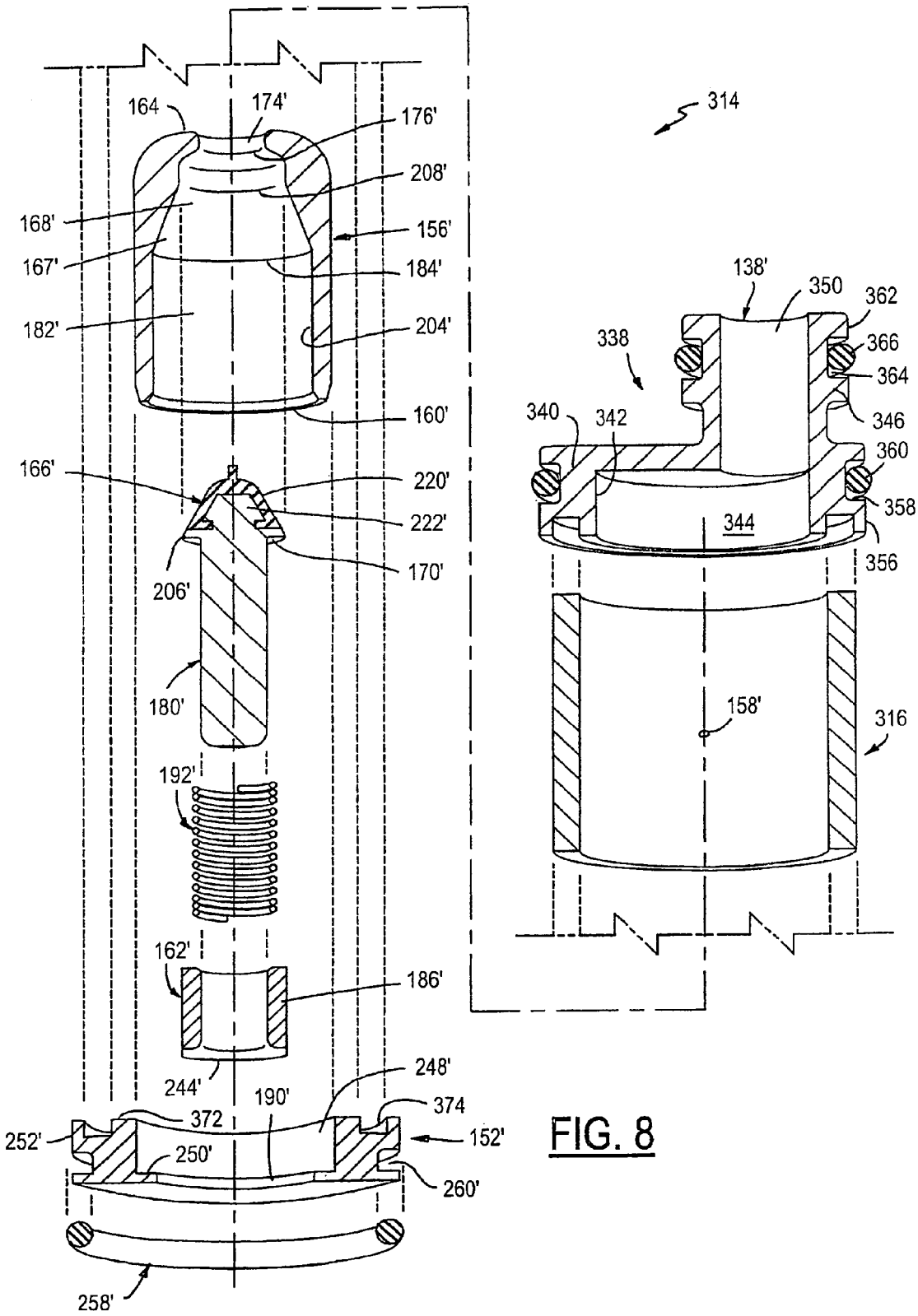
FIG. 8 is an exploded cross sectional perspective view of the bypass pressure regulator of FIG. 7.
Figure 9:
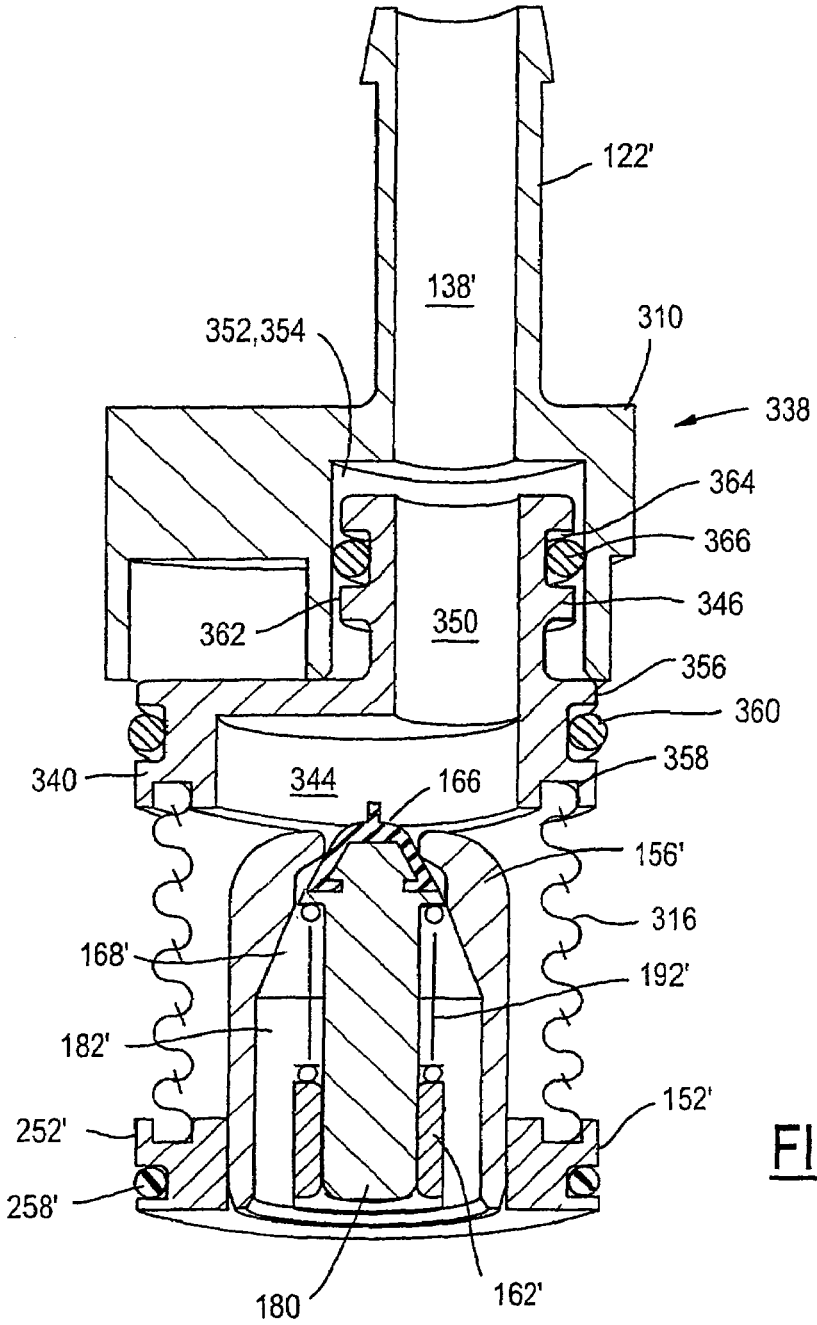
FIG. 9 is a cross sectional perspective view of the bypass pressure regulator of FIG. 7.
Figure 10:
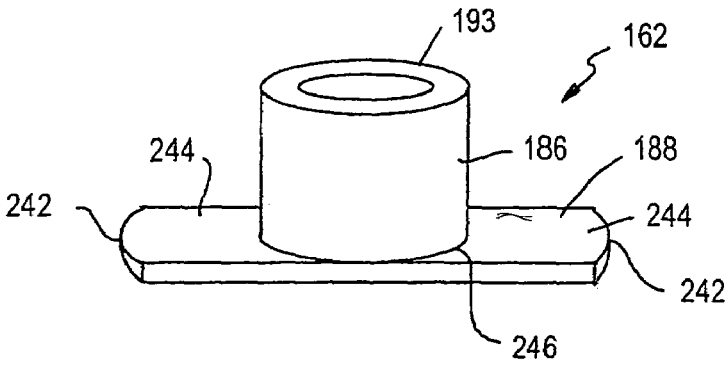
FIG. 10 is a perspective view of a guide member of the embodiments of the bypass pressure regulator.

Referring to FIGS. 7–9, a second application of a bypass pressure regulator 120' is illustrated wherein similar elements to that of the first application are identified with the same numeral and an added "prime" symbol. A returnless fuel supply system 124' for a combustion engine has a fuel tank 130' defining a fuel chamber 300 and a versatile fuel pump module 302 located in the chamber. During assembly, the module 302 is inserted through an access hole 304 of the tank 130' which is covered sealably by a flange 306 of the module 302.

Suspended rigidly from the flange 306 in the chamber 300 of the tank 130' are two spring loaded shocks or vertical displacement struts 308 (one shown) which fit slidably into strut guides (not shown) of a structural pod 310 to yieldably support the pod 310 of the fuel pump module 302 so that a bottom or bottom cover plate 312 of the pod is generally located and held against a bottom wall of the tank 130' even if the tank walls should slightly flex, expand, or contract. The pod 310 houses and supports numerous components including a fuel pump 128', an electric motor 312 coupled to the pump, and a filter cartridge 314 having a filter element 316 and an integrated bypass pressure regulator 120'. Fuel flows generally between the components via the pod 310 thus eliminating the need for conventional hoses, tubes and fittings. Power leads or wires 318 are routed from the motor 312 and through a sealing grommet 320 of the flange 306.

The pod 310 carries an inner cylindrical first surface 322 defining a first bore 324 having a central axis 326 extending substantially vertically, and an inner cylindrical second surface 328 defining a second bore 330 spaced radially outward from the first bore 324 and having a central axis 158' disposed substantially parallel to the central axis 326 of the first bore 324. The pump and motor 128', 312 are assembled in the first bore 324 and the filter cartridge 314 is assembled in the second bore 330.

During manufacture, components of the fuel pump 128' are preferably assembled into the first bore 324 through an open top end and are generally nestled against a continuous bottom shoulder 332 projecting radially and unitarily inward from the first cylindrical surface 322. After the fuel pump 128' is assembled, the pump motor 312 which has a stator encircling an armature with a drive shaft 334 journaled for rotation by a pair of bearings is inserted into the first bore 324 from above and coupled mechanically to the pump 128'. The open end is then sealed-off by a cap 336 which preferably carries one set of the bearings. At least one electrical lead 318 extends through the end cap 336. When operating, fuel enters the pump 128' through an inlet or bottom port 134' generally defined by the shoulder 332 of the pod 310 and pressurized fuel exits the pump 128' and flows into the second bore 330 via an outlet or fuel passage 136' defined by the pod 310 and communicating through the first and second surfaces 322, 328.

The reversible filter cartridge 314 is preferably pre-assembled with the integral bypass pressure regulator 120' located radially inward from the cylindrical fuel filter element 316. The filter element 316 is located axially between an inverted funnel-like primary end retainer 338 for flowing the supply fuel identified by arrow 140' and a secondary end retainer 152' of the cartridge 314 for flowing the bypass fuel identified by arrow 142'. Each disc-like retainer 338, 152' defines a circular groove 340 (as best shown in FIG. 8) which oppose one-another in an axial direction for seating opposite ends 342 of the cylindrical filter element 316 and spacing the element radially inward from the second cylindrical surface 328 to maximize filtration efficiency and filter surface area. This construction also prevents shifting of the filter element 316 within the second bore 330 and prevents bypassing of the fuel around the filter element 316.

The primary end retainer 338 has an inverted bowl-like base portion 340 which carries a cylindrical inward face 342 that defines in-part a fuel cavity 344 of the channel 138' held at system operating pressure by the bypass pressure regulator 120', and a collar portion 346 which projects upward from the base portion 340 and defines a supply fuel outlet passage 350 of the channel 138' that communicates axially with the cavity 344. The collar portion 346 projects into a counter bore 352 defined by a cylindrical third surface 354 carried by the pod 310. An outer radial face 356 of the base portion 340 defines a continuous slot 358 which seats a resilient seal or preferable O-ring 360 that seals to the second surface 328 of the second bore 330. An outer radial face 362 of the collar portion 346 also defines a continuous slot 364 which seats an O-ring 366 that seals to the third surface 354 of the counter bore 352, and likewise, an outer radial face 252' of the secondary end retainer 152' defines a continuous slot or groove 260' which seats an O-ring 258' that seals to the second surface 328 of the second bore 330. All three O-rings 360, 366, 258' and the seating arrangement of the filter element 316 to the retainers 152' 338 assure that all of the fuel flowing from the fuel passage 136' is filtered before entering the pressurized fuel cavity 344 of the channel 138'.

After filtration, the fuel which enters the cavity 344 primarily flows upward through the fuel outlet passage 350 of the collar portion 346, through an upward projecting barbed nipple 368 of the pod 310 and into a flexible tube 370 of the conduit 122' press fitted to the nipple 368 and extending upward to couple to a similar nipple 372 projecting downward from the flange 306 (as best shown in FIG. 7). From the flexible tube 370, the fuel generally flows out of the tank. When system fuel pressure is exceeded by the pump 128', the bypass pressure regulator 120' will open allowing bypass fuel 142' to flow from the pressure cavity 344 and through the secondary retainer 152' back to the tank chamber 300.

A dome structure 156' of the bypass pressure regulator 120' projects axially and concentrically upward from the retainer 152' and is spaced radially inward from and generally aligned axially to the filter element 316. The pressurized fuel cavity 344 is thus generally defined axially between the primary end retainer 338 and an annular face 372 of the retainer 152' which spans radially between a continuous groove 374, which receives an end rim 160' of the dome structure 156', and the dome structure 156'. The cavity 344 is generally defined radially between the dome structure 156' and the outer filter element 316.

When fuel system pressure is exceeded, the biased closed bypass pressure regulator 120' opens, compressing a biasing spring 192' axially as a valve head 166' moves axially downward away from a seat 176' carried by the dome structure 156'. Bypass fuel 142' flows through an inlet port 174' generally defined by the seat 176' and downward through a valve chamber 168' and communicating bypass passage 182', both defined by the dome structure 156'. The bypass fuel 142' then exits the second bore 330 through a hole 190' of the retainer 152' and through a slightly larger hole 374 of the cover 312 for holding the filter cartridge 314 axially in the second bore 330. During manufacture, at least one and preferably three upward projecting flex arms 378 of the cover 312 snap fit to the pod 310 to lock the cartridge 314 within the second bore 330. Preferably, the arms 378 each have a slot 380 which receives a ramped tab 382 projecting outward from the pod 310, thus locking the cover 312 in-place.

While the forms of the invention herein disclosed constitute presently preferred embodiments, many others are possible. For instance, the conduit 122 can be a liquid storage pressure vessel and the channel 138 can be a pressure chamber for the storage of liquid, and not necessarily the flow of liquid. In such an application, the bypass pressure regulator 120 will actually function as a pressure relief regulator. It is not intended herein to mention all the possible equivalent forms or ramification of the invention. It is understood that terms used herein are merely descriptive, rather than limiting, and that various changes may be made without departing from the spirit or scope of the invention as defined by the following claims.

We claim:

1. A bypass pressure regulator communicating with a conduit for flowing liquid, the bypass pressure regulator comprising:

a body;

a valve chamber defined by the body and disposed concentrically about a center axis, the valve chamber having a bypass outlet port;

an inlet and an outlet continuously communicating with the inlet;

a seat carried by the body, communicating with the inlet and defining in part the valve chamber;

a continuous inner surface carried by the body, defining in part the valve chamber, concentric with the center axis, disposed axially downstream of the seat and radially expanding downstream of the seat;

a biased closed and enlarged valve head disposed at least in part in the valve chamber, the valve head being in sealed contact with the seat when the valve head is in a closed position to prevent liquid flow through the valve chamber and spaced axially away from the seat when the valve head is in an open position to permit liquid flow through the valve chamber and the bypass outlet port; and a peripheral outer edge of the valve head radially fitted closely to the continuous inner surface when the valve head is in the closed position.

2. The bypass pressure regulator set forth in claim 1 wherein the bypass pressure regulator does not have a flexible diaphragm.

3. The bypass pressure regulator set forth in claim 1 comprising:

the valve head being substantially conical in shape;

an upstream portion of the continuous inner surface;

a downstream portion of the continuous inner surface expanding radially outward from the upstream portion; and a peripheral inner edge of the continuous inner surface formed by the congruent connection between the upstream and downstream portions wherein the peripheral outer edge is substantially axially aligned to the peripheral inner edge when the valve head is in the closed position and the peripheral outer edge is axially aligned to the downstream portion and spaced axially away from the peripheral inner edge when the valve head is in the open position.

4. The bypass pressure regulator set forth in claim 3 wherein the upstream portion is cylindrical.

5. The bypass pressure regulator set forth in claim 4 comprising:

a bypass passage defined by the body and communicating with the valve chamber at an outlet port;

a valve shank projecting axially downstream of the enlarged valve head and disposed at least in part in the bypass passage;

a guide member supported by the body for guiding the valve shank; and a compression spring disposed operatively and axially between the enlarged valve head and the guide member for biasing the enlarged valve head in the closed position.

6. The bypass pressure regulator set forth in claim 1 comprising:

a bypass passage defined by the body and communicating with the valve chamber at an outlet port;

a valve shank projecting axially downstream of the valve head and disposed at least in part in the bypass passage;

a guide member of the body for guiding the valve shank; and a compression spring disposed operatively and axially between the enlarged valve head and the guide member for biasing the valve head in the closed position.

7. The bypass pressure regulator set forth in claim 5 wherein the compression spring is disposed concentrically to the valve shank.

8. The bypass pressure regulator set forth in claim 6 comprising:

a dome-like structure of the body defining the valve chamber and the bypass passage, the dome-like structure having a continuous end rim;

an annular retainer of the body fitted sealably to the end rim, the annular retainer having a hole communicating with the bypass passage;

a collar portion of the guide member for sliding receipt of the valve shank; and a structural portion of the guide member projecting radially from the annular retainer to the collar portion and across the hole.

9. The bypass pressure regulator set forth in claim 8 comprising a first leg of the structural portion projecting radially outward from the collar portion and to a distal end press fitted axially between the dome-like structure and a radially inward projecting shelf of the annular retainer.

10. The bypass pressure regulator set forth in claim 9 comprising a second leg of the structural portion diametrically opposed to the first leg and having a distal end press fitted axially between the dome-like structure and the shelf of the annular retainer.

11. A bypass pressure regulator comprising:

a body defining a valve chamber having a center axis and a bypass outlet;

an inlet and an outlet continuously communicating with the inlet;

a valve seat carried by the body upstream of the bypass outlet, communicating with the inlet, concentric with the center axis, and defining in part the valve chamber;

a valve head disposed at least in part in the valve chamber between the valve seat and the bypass outlet, the valve head being in sealed contact with the seat when in a biased closed position to prevent flow through the valve chamber and spaced away from the seat when the valve head is in an open position to permit flow through the valve chamber and bypass outlet, the valve head having a peripheral outer edge;

a circumferentially continuous inner surface carried by the body, disposed downstream of the valve seat, defining in part the valve chamber and transitioning radially outward in a downstream direction and with respect to the center axis;

a close fit region of the valve chamber defined radially between the continuous inner surface and the peripheral outer edge when the valve head is in the closed position; and a free flow region of the valve chamber disposed generally downstream of the close fit region, defined radially between the continuous inner surface and the peripheral outer edge when the valve head is in the open position, and wherein the free flow region is larger in area than the area of the close fit region.

12. The bypass pressure regulator set forth in claim 11 wherein the valve seat is generally annular with respect to the center axis and faces substantially in a downstream direction.

13. The bypass pressure regulator set forth in claim 12 wherein the valve head substantially tapers radially outward in a downstream direction and to the peripheral outer edge.

14. The bypass pressure regulator set forth in claim 11 further comprising:

a cylindrical portion of the continuous inner surface;

an expanding portion of the continuous inner surface disposed congruently to and disposed downstream of the cylindrical portion;

a crest of the continuous inner surface formed between the cylindrical portion and the expanding portion; and the peripheral outer edge being axially aligned to the cylindrical portion when the valve head is in the closed position and being axially aligned to the expanding portion when the valve head is in the open position.

15. The bypass pressure regulator set forth in claim 14 wherein the peripheral outer edge does not contact the cylindrical portion.

16. The bypass pressure regulator set forth in claim 14 wherein the expanding portion is conical in shape and the crest is circular.

17. The bypass pressure regulator set forth in claim 16 wherein the valve head is tapered more than the expanding portion.

18. A liquid fuel bypass pressure regulator in a returnless fuel system of a combustion engine having a fuel pump which flows pressurized fuel to at least one fuel injector, the bypass pressure regulator comprising:

a body engaged having a fuel inlet and a fuel outlet continuously communicating with the fuel inlet;

a valve chamber defined by the body, and disposed concentrically about a center axis and having a fuel bypass outlet;

a seat carried by the body, communicating with the fuel inlet, disposed upstream of the bypass outlet, and defining in part the valve chamber;

a continuous inner surface carried by the body, defining in part the valve chamber, and spaced axially downstream of the seat and upstream of the bypass outlet;

a biased closed valve head disposed at least in part in the valve chamber, the valve head being in sealed contact with the seat when the valve head is in a closed position to prevent fuel flow through the valve chamber and spaced axially away from the seat when the valve head is in an open position for flowing fuel from the fuel inlet and through the valve chamber and bypass outlet; and a peripheral outer edge of the valve head fitted closely and spaced slightly from the continuous inner surface when the valve head is in the closed position and spaced farther away from the continuous inner surface when the valve head is in the open position.

19. The fuel bypass pressure regulator set forth in claim 18 wherein the regulator does not have a flexible diaphragm.

20. The fuel bypass pressure regulator set forth in claim 18 comprising:

a first imaginary plane disposed perpendicular to the center axis;

a second imaginary plane disposed perpendicular to the center axis and spaced axially downstream of the first imaginary plane;

a third imaginary plane disposed perpendicular to the center axis and spaced axially downstream of the second imaginary plane;

wherein the valve seat generally lies in the first imaginary plane;

wherein the peripheral outer edge generally lies in the second imaginary plane when the valve head is in the closed position and lies in the third imaginary plane when the valve head is in the open position;

a seat diameter of the valve seat measured in the first imaginary plane;

an edge diameter of the peripheral outer edge;

a first diameter of the continuous inner surface measured in the second imaginary plane;

a second diameter of the continuous inner surface measured in the third imaginary plane; and wherein the seat diameter is less than the edge diameter which is slightly less than the first diameter which is less than the second diameter.

21. The fuel bypass pressure regulator set forth in claim 20 further comprising:

the valve head being substantially conical in shape;

a conical portion of the continuous inner surface being located immediately downstream of the peripheral outer edge when the valve head is in the closed position, the conical portion having the second diameter; and a cylindrical portion of the continuous inner surface being located immediately upstream from the conical portion and having the first diameter.

22. The fuel bypass pressure regulator set forth in claim 21 further comprising an annular concave portion of the continuous inner surface disposed congruently axially between the valve seat and the cylindrical portion, and defining in part the valve chamber.

23. The fuel bypass pressure regulator set forth in claim 21 comprising:

a bypass passage defined by the body and communicating with the bypass outlet;

a valve shank attached to and projecting axially downstream of the valve head and disposed at least in part in the bypass passage;

a guide member supported by the body for guiding the valve shank; and a compression spring disposed operatively and axially between the enlarged valve head and the guide member for biasing the valve head in the closed position.

24. The fuel bypass pressure regulator set forth in claim 18 comprising:

a bypass passage defined by the body and communicating with the bypass outlet;

a valve shank attached concentrically to and projecting axially downstream of the valve head and disposed at least in part in the bypass passage;

a guide member of the body for guiding the valve shank; and a compression spring disposed operatively and axially between the enlarged valve head and the guide member for biasing the valve head in the closed position.

25. The fuel bypass pressure regulator set forth in claim 24 wherein the compression spring is disposed concentrically to the valve shank.

26. The fuel bypass pressure regulator set forth in claim 25 further comprising:

a dome-like structure of the body defining the valve chamber and the bypass passage, the dome-like structure having a continuous end rim;

an annular retainer of the body fitted sealably to the end rim of the dome and engaged sealably to the conduit, the annular retainer having a hole communicating with the bypass passage;

a collar portion of the guide member for sliding receipt of the valve shank; and a structural portion of the guide member projecting radially outward from the collar portion across the hole and attaching to the annular retainer.

27. A retumless fuel system of a combustion engine comprising:

at least one fuel injector;

a fuel pump; and a diaphragm-less bypass pressure regulator for controlling the pressure of fuel supplied to the at least one fuel injector, the bypass pressure regulator having;

a body having a fuel inlet communicating with the fuel pump and a fuel outlet communicating with the fuel inlet and the at least one fuel injector;

a valve chamber defined by the body having a bypass outlet and disposed concentrically about a center axis, a seat carried by the body, communicating the inlet with the valve chamber upstream of the bypass outlet and defining in part the valve chamber, a continuous inner surface carried by the body, defining in part the valve chamber, extending axially downstream from the seat and transitioning radially outward in a downstream direction, a biased closed valve head disposed at least in part in the valve chamber, the valve head being in sealed contact with the seat when the valve head is in a closed position to prevent fuel flow through the valve chamber and spaced axially away from the seat when the valve head is in an open position to permit fuel flow through the valve chamber and the bypass outlet, and a peripheral outer edge of the valve head fitted closely and spaced slightly away from the continuous inner surface when the valve head is in the closed position and spaced farther away from the continuous inner surface when the valve head is in the open position.

28. The retumless fuel system set forth in claim 27 wherein the fuel pump and the bypass pressure regulator are located in a fuel tank.

29. The retumless fuel system set forth in claim 28 comprising a fuel filter interposed in the conduit between the bypass pressure regulator and the at least one fuel injector.

30. The retumless fuel system set forth in claim 29 wherein the fuel filter is located in the fuel tank.

31. The returnless fuel system set forth in claim 30 further comprising:

a filter cartridge having the fuel filter and integrated with the bypass pressure regulator;

the fuel filter being a cylindrical filter element which traverses the channel of the conduit and has first and second opposite ends;

a dome-like structure of the body defining the valve chamber and the inlet port, disposed substantially inside the cylindrical filter element and having a continuous end rim disposed axially opposite the inlet port;

an annular retainer of the body engaged sealably to the end rim of the dome and engaged sealably to the conduit, the annular retainer having a hole communicating with the valve chamber and a continuous groove located radially outward from the dome-like structure for sealable receipt of the first end of the filter element; and the conduit having a continuous groove for sealable receipt of the second end of the filter element so that all fuel flowing from the pump flows through the filter element.

* * * * *

UNITED STATES PATENT AND TRADEMARK OFFICE

CERTIFICATE OF CORRECTION

PATENT NO. : 7,210,460 B2
APPLICATION NO. : 11/114843
DATED : May 1, 2007
INVENTOR(S) : Yoshiaki Douyama et al.

It is certified that error appears in the above-identified patent and that said Letters Patent is hereby corrected as shown below:

Column 12
Line 48, delete “engaged”.

Column 12
Line 50, delete “and”.

Signed and Sealed this

Third Day of July, 2007

JON W. DUDAS
*Director of the United States Patent and Trademark Office*